US010694279B1

(12) United States Patent
Danovi

(10) Patent No.: US 10,694,279 B1
(45) Date of Patent: Jun. 23, 2020

(54) COMPACT COAXIAL LOUDSPEAKER

(71) Applicant: Alpine Electronics, Inc., Ota-ku, Tokyo (JP)

(72) Inventor: Benny Danovi, Ypsilanti, MI (US)

(73) Assignee: Alpine Electronics, Inc., Tokyo (JP)

( * ) Notice: Subject to any disclaimer, the term of this patent is extended or adjusted under 35 U.S.C. 154(b) by 26 days.

(21) Appl. No.: 16/229,953

(22) Filed: Dec. 21, 2018

(51) Int. Cl.

| | |
|---|---|
| ***H04R 1/00*** | (2006.01) |
| ***H04R 1/24*** | (2006.01) |
| ***H04R 1/30*** | (2006.01) |
| ***H04R 9/06*** | (2006.01) |
| ***H04R 9/02*** | (2006.01) |
| ***H04R 1/32*** | (2006.01) |

(52) U.S. Cl.
CPC ..... *H04R 1/24* (2013.01); *H04R 1/30* (2013.01); *H04R 1/323* (2013.01); *H04R 9/025* (2013.01); *H04R 9/063* (2013.01)

(58) Field of Classification Search
CPC ..... H04R 1/24; H04R 1/26; H04R 9/063
See application file for complete search history.

(56) References Cited

U.S. PATENT DOCUMENTS

| | | | | |
|---|---|---|---|---|
| 4,122,315 | A * | 10/1978 | Schroeder | H04R 1/24 181/147 |
| 4,365,114 | A | 12/1982 | Soma | |
| 6,829,366 | B2 | 12/2004 | Tanabe | |
| 7,283,642 | B2 | 10/2007 | Milot et al. | |
| D559,835 | S | 1/2008 | Marshall | |
| 7,433,487 | B2 | 10/2008 | Shimamura | |
| D652,408 | S | 1/2012 | Chen | |
| 8,150,095 | B2 | 4/2012 | Kemmerer | |
| 8,391,519 | B2 * | 3/2013 | Chen | H04R 1/24 381/182 |
| 8,452,042 | B2 | 5/2013 | Diedrich et al. | |
| 8,983,104 | B2 | 3/2015 | Shimamura | |
| 9,479,873 | B2 | 10/2016 | Yamagami et al. | |
| 2004/0047478 | A1 * | 3/2004 | Combest | H04R 1/24 381/182 |
| 2004/0125969 | A1 * | 7/2004 | Kieltyka | H04R 1/26 381/182 |
| 2005/0276436 | A1 * | 12/2005 | Kobayashi | H04R 1/06 381/409 |
| 2006/0023903 | A1 * | 2/2006 | Hayashi | H04R 1/24 381/182 |

(Continued)

FOREIGN PATENT DOCUMENTS

| | | |
|---|---|---|
| JP | 1990113488 | 9/1990 |
| JP | 1994269076 | 9/1994 |

(Continued)

OTHER PUBLICATIONS

Wet Sounds, "Owner's Manual," Wet Sounds Inc., Mar. 20, 2012, 2 pages.

*Primary Examiner* — Matthew A Eason
(74) *Attorney, Agent, or Firm* — Knobbe, Martens, Olson & Bear, LLP

(57) ABSTRACT

A loudspeaker can include first and second drivers. The first driver can include a cone that has a center region, a peripheral region surrounding the center region, and a boundary connecting the center region and the peripheral region. A bridge can position the second driver coaxial with and proximal to the first driver. The center region of the cone can be recessed to allow a lower profile of the loudspeaker.

20 Claims, 4 Drawing Sheets

(56) References Cited

U.S. PATENT DOCUMENTS

| | | | | |
|---|---|---|---|---|
| 2009/0003632 | A1* | 1/2009 | Lin | H04R 1/24 381/182 |
| 2014/0056436 | A1* | 2/2014 | Kim | G10K 11/002 381/71.7 |
| 2014/0363035 | A1* | 12/2014 | Zhao | H04R 9/04 381/182 |
| 2015/0237449 | A1* | 8/2015 | Papp | H04R 7/16 381/398 |
| 2018/0279039 | A1* | 9/2018 | Matsumura | H04R 1/2857 |

FOREIGN PATENT DOCUMENTS

| | | |
|---|---|---|
| JP | 1999341574 | 12/1999 |
| JP | 3657814 | 6/2005 |
| JP | 3946047 | 7/2007 |
| JP | 2008131269 | 6/2008 |

* cited by examiner

COMPACT COAXIAL LOUDSPEAKER

BACKGROUND

Field

This disclosure relates generally to loudspeakers and particularly to coaxial loudspeakers.

Description of Related Art

Loudspeakers provide listeners quality sound audible from a distance and through various media. Various configurations of loudspeakers have been developed over the years. Current coaxial loudspeakers have some functionality with regard to producing compact profiles. However, many features are lacking, and many problems exist in the art for which this application provides solutions.

SUMMARY

Example embodiments described herein have innovative features, no single one of which is indispensable or solely responsible for their desirable attributes. Without limiting the scope of the claims, some of the advantageous features will now be summarized.

In some embodiments, a coaxial loudspeaker includes a first driver, a second driver, and a bridge. The first driver can include a magnetic circuit having a front plate assembly. The first driver can include a voice coil positioned within the magnetic circuit The first driver can include a bobbin connected to the voice coil and a cone attached to the bobbin. The cone can include a center region, a peripheral region surrounding the center region, and a boundary connecting the center region and the peripheral region. The bridge can be configured to position a second driver coaxial with and proximal to the first driver. The loudspeaker can include a cone displacement region that is configured to permit displacement of the cone of the first driver, wherein the cone displacement region is disposed between the second driver and the front plate assembly of the first driver. The center region of the cone can be recessed distally from the boundary.

In some embodiments, a coaxial loudspeaker includes a first driver disposed distal to a second driver. The second driver may be configured to produce higher audio frequencies than the first driver and may include a base and a diaphragm that is proximal to the base. The diaphragm can be configured to have a maximum displacement between an activated state and a resting state. The loudspeaker may include a bridge that is configured to position the second driver coaxial with the first driver. The bridge can extend radially outward of the diaphragm at an attachment point and define a mounting depth from a base of the attachment point and the base of the first driver. A ratio of the mounting depth (mm) to the maximum displacement (in mm) can be less than about 7.

BRIEF DESCRIPTION OF THE DRAWINGS

The following drawings and the associated descriptions are provided to illustrate embodiments of the present disclosure and do not limit the scope of the claims.

Figure 1:
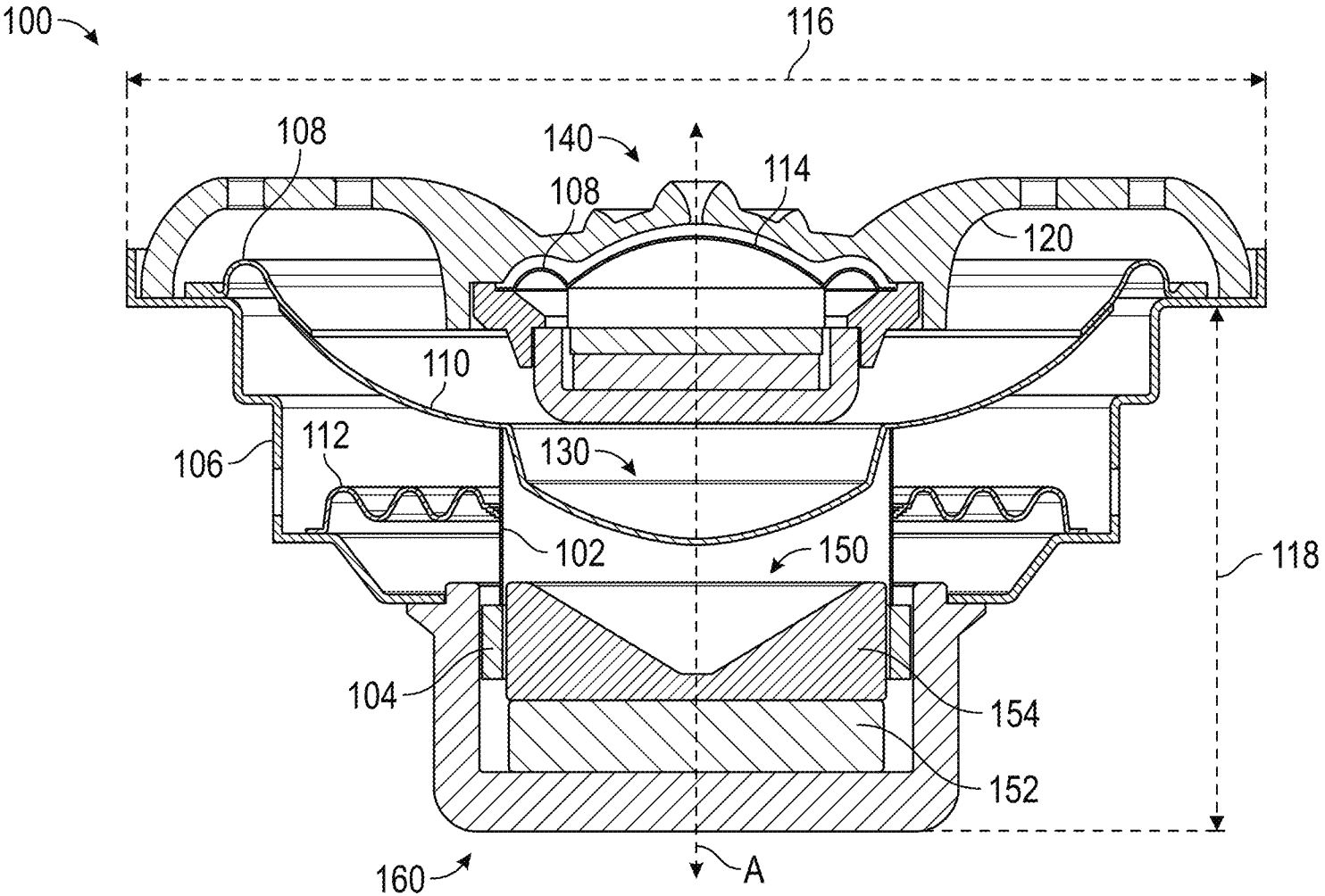
FIG. 1 schematically shows a cross-section of an example coaxial loudspeaker design.

These and other features will now be described with reference to the drawings summarized above. The drawings and the associated descriptions are provided to illustrate embodiments and not to limit the scope of any claim. Throughout the drawings, reference numbers may be reused to indicate correspondence between referenced elements. In addition, where applicable, the first one or two digits of a reference numeral for an element can frequently indicate the figure number in which the element first appears.

DETAILED DESCRIPTION

There is a need to have a high output, wide bandwidth coaxial loudspeaker within a small space and/or with limited mounting depth. Additionally, for the protection of the low frequency loudspeaker motor assembly and maximizing acoustic radiating surface area it may be desirable to have a voice coil bobbin that is closed on the top. Disclosed herein are various implementations of a coaxial loudspeaker that can, for example, use a low frequency transducer with a uniquely shaped one-piece cone assembly (e.g., with no dust cap) to provide a sealed magnetic gap and improved acoustic radiating surface area while providing mechanical clearance to a high frequency driver in front of it and the pole plate below it when operating at high displacements. This can allow the low frequency driver to provide a higher sound pressure level (SPL) at lower frequencies than it otherwise would.

As described in more detail below, the low frequency transducer can have a uniquely shaped one-piece cone with a concave center region that sits inside of the voice coil bobbin. The portion of the cone radially adjacent to the concave center section can sit on top of the voice coil former. The cone and voice coil bobbin can be adhered together radially at this junction point or boundary. The high frequency transducer can be coaxially mounted in front of (e.g., proximally to) the low frequency transducer via a bridge structure. The concave center portion of the low frequency transducer cone can be shaped to allow the rear of the tweeter to nest into the center of the cone without causing substantial mechanical interference when the cone is moving at high displacements.

The low frequency transducer's central magnetic pole plate can also be shaped in such a way as to allow the rear of the center of the cone to clear the pole plate without causing any mechanical interference when the cone is moving rearward at high displacements. Embodiments described herein can allow for a high output extended bandwidth implementation of coaxial loudspeakers with bridge type tweeter mounts and a closed motor structure in a much shallower package than previously possible. Certain implementations can allow for +/−6 mm of excursion within a mounting depth of only 40.5 mm even with a horn loaded tweeter mounted in front of the low frequency transducer. The effective bandwidth enabled by certain embodiments described herein can be about 100 Hz to about 40 kHz.

Although certain embodiments and examples are disclosed below, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Described herein are methodologies and related systems for loudspeakers, particularly coaxial speakers. It will be understood that although the description herein is in the context of coaxial loudspeakers, one or more features of the present disclosure can also be implemented in loudspeaker designs.

Unless explicitly indicated otherwise, terms as used herein will be understood to imply their customary and ordinary meaning.

FIG. 1 schematically shows a cross-section of a coaxial loudspeaker 100. The loudspeaker 100 may include one or more components described herein. However, because not every element of the loudspeaker 100 is required in every embodiment, no single element should be viewed as indispensable to the loudspeaker 100. The loudspeaker 100 shown in FIG. 1 uses a core magnet design, but a circular magnet (or annular magnet) design may also be implemented using designs substantially similar to those described herein with modest adjustments.

The loudspeaker 100 is shown with a central axis A about which the loudspeaker 100 has approximate radial symmetry, or alternatively shows a nonaxisymmetric arrangement along central axis A with a minor axis direction and major axis direction. Accordingly, FIG. 1 represents elements that may appear to be duplicated but may be representative of a common element disposed about an axis. In some designs, however, multiple elements may be used for a single feature.

The loudspeaker 100 includes a first driver 130 and a second driver 140. The drivers 130, 140 may be disposed coaxially (e.g., along the central axis A) with each other. For example, a bridge 120 can be configured to dispose the second driver 140 coaxial with and proximal to the first driver 130. The loudspeaker 100 can include a frame 106. In some embodiments, the frame 106 may be called a basket or a housing. At or near a first end of the frame 106, the frame may be attached to a front plate assembly 154 of a magnetic circuit assembly 150. In some embodiments, a yoke assembly 160 may include a receiving portion for receiving the attachment of the frame 106. However, in some embodiments, the front plate assembly 154 comprises a receiving portion for receiving the attachment of the frame 106. The frame 106 may be adhered (e.g., glued), bonded (e.g., soldered, welded), or otherwise affixed in another way to the yoke assembly 160 and/or the front plate assembly 154. For example, in some embodiments a pressure fit configuration may be used. In some designs, one or more screws may be used to attach the frame 106 to the front plate assembly 154. In some embodiments, the frame 106 may be attached to a resilient connector 108 at or near a second end of the frame. In some embodiments, the frame 106 may be attached directly to a diaphragm 110.

The frame 106 may comprise a thin plate of a rigid material (e.g., steel, plastic, synthetic resin, wood, etc.). In some embodiments, the frame 106 comprises a nonmagnetic material (e.g., aluminum or aluminum alloy). The frame 106 may also attach to a damper 112. The frame 106 may exhibit radial symmetry or approximate radial symmetry about the central axis A.

The resilient connector 108 may be called a surround, an elastic edge, or an outer suspension. The resilient connector 108 may be bonded to the frame 106. The resilient connector 108 may be attached to the frame 106 using an attachment device. For example, in some designs a gasket can be used. In some embodiments, the resilient connector 108 comprises a thin sheet of rigid or resilient material. Because it comprises a sufficiently thin material, even if the material is rigid, the resilient connector 108 can support minor perturbations between the frame 106 and the diaphragm 110.

The loudspeaker 100 may also include a damper 112. The damper 112 may also be referred to as a spider or inner suspension in some embodiments, though other terms may be used. A first end of the damper 112 may be connected to the frame 106 closer to the first end than the second end of the frame 106. A second end of the damper 112 may be attached to a bobbin 102. The damper 112 may support the bobbin 102 to allow the bobbin 102 to vibrate while preventing or reducing contact of either the bobbin 102 or coil 104 with parts of the magnetic circuit assembly 150 (e.g., the front plate assembly 154, pole piece 158). The bobbin 102 may be attached to the damper 112 in a number of different ways (e.g., bonded, adhered). In some embodiments, the damper 112 may comprise a resin-containing cloth. The damper 112 may comprise a resin plate that forms a ring. As shown from the side, as in FIG. 1, the damper 112 may be radially corrugated. The radially corrugation may be formed concentric with the central axis A.

A loudspeaker 100 may generally include a diaphragm 110. As the diaphragm vibrates, sound may be produced and/or amplified. The diaphragm 110 may also be referred to as a cone (e.g., sound cone). The diaphragm 110 may have a circular, elliptical, obround, square or rectangular shape. As described in more detail below, the diaphragm 110 may include a single and/or unitary element. For example, as shown, the diaphragm 110 may extend radially from a center and contain no hole in a center of the diaphragm 110. The diaphragm 110 may comprise a resilient material (e.g., resin, cloth, plastic, polymers, paper, fibers, paper-mineral composites, metal, etc.). In many embodiments, the diaphragm 110 is radially symmetrical about the central axis A, or non-axisymmetric about the central axis A, with a minor axis direction and major axis direction. In such embodiments, sound can be concentrated in a direction along the central axis A. The diaphragm 110 (e.g., at an inner periphery of the diaphragm 110) may be attached to or near a first end of the bobbin 102. The resilient connector 108 may be attached (e.g., bonded, adhered) to an outer periphery of the diaphragm 110. In certain embodiments, no cap (also referred to as a dust cap, dust cover, or dome) is included in the loudspeaker 100. This may be because the diaphragm 110 is a unitary and/or closed element that prevents dust, debris, or water substantially from contacting the magnetic circuit assembly 150. The diaphragm 110 may "close" the bobbin 102. This closure may serve as a protective seal and/or may be water tight. As shown, in some designs the diaphragm 110 has a concave shape along a center portion and/or along a periphery.

In some embodiments, the loudspeaker 100 includes a bobbin 102. In some embodiments, the bobbin 102 may be referred to as a former or coil former. The bobbin 102 may form a ring surrounding the central axis A. The bobbin 102 can attach to the diaphragm 110 at a boundary (described more fully below). Thus, the bobbin 102 can form a boundary plane along the attachment of the bobbin 102 and the diaphragm 110 substantially perpendicular to the axis A. In some designs, the bobbin 102 extends axially at least to an axial position of the front plate assembly 154. Accordingly, the bobbin 102 may form a cylindrical shape. However, the bobbin 102 may extend axially below the 154. Other alternatives are possible. As shown, the diaphragm 110 and/or the damper 112 may be attached (e.g., bonded, adhered) to or near a first axial end of the bobbin 102. The bobbin 102 may attach to an underside or distal side of the diaphragm 110.

The bobbin 102 may be configured to support a coil 104. The coil 104 may be referred to as a voice coil in some embodiments. The coil 104 may be attached or otherwise secured to the bobbin 102 using a number of means (e.g., adhered, bonded). The coil 104 can be configured to receive an electric current therethrough. The electric current creates a magnetic field that interacts with a magnetic field produced by the magnet 152. For example, the interaction may cause the coil 104 to translate axially back and forth. This interaction can cause the coil 104, and thereby the bobbin 102, to vibrate axially along the central axis A and/or radially. The vibration can be transferred to, for example, the diaphragm 110 to be displaced by an amplitude above and below a rest position of the diaphragm 110. This displacement of the diaphragm 110 can produce a target sound based on an electrical input.

The coil 104 may comprise a series of windings of a conductive material (e.g., metal) wrapped around the bobbin 102. The windings may have a radial thickness extending radially from the bobbin 102. The coil 104 may be disposed between an outer radius of the pole piece 158 and an inner radius of the front plate assembly 154. In some designs, the coil 104 comprises the same number of windings (e.g., turns) of the conductive material axially along the portion of the bobbin 102 to which it is secured. Having such a homogeneous distribution of windings can create a more uniform magnetic field along the height (e.g., measured axially) of the coil 104. The height of the coil 104 may be less than a corresponding height of the front plate assembly 154 and/or portion of the pole piece 158.

The loudspeaker 100 generally includes a magnetic circuit assembly 150 of the first driver 130. Generally, the magnetic circuit assembly 150 may include a front plate assembly 154, a magnet 152, and a yoke assembly 160. The yoke assembly 160 may comprise one or more plates. In some embodiments, the yoke assembly 160 may include the pole plate 158. As in the other elements described with reference to FIG. 1, the elements of the magnetic circuit assembly 150 are depicted only schematically. For example, the front plate assembly 154 may comprise one or more elements. Similarly, the magnet 152, back plate 156, and/or pole plate 158 may comprise one or more elements.

In some embodiments, the front plate assembly 154 is axially adjacent the magnet 152 and can have a central axis in common with the central axis A of the magnet 152. However, other arrangements are possible. The front plate assembly 154 may be secured to the magnet 152. For example, the front plate assembly 154 may be attached using an adhesive (e.g., glue) or a bonding technique. The region where the front plate assembly 154 is attached to the magnet 152 can be called an interface layer. It may be advantageous to reduce a distance (e.g., gaps) between the front plate assembly 154 and the magnet 152, such as a thickness of the interface layer, which can comprise glue or other connection material.

A magnet 152 may be used to create a magnetic flux across a gap between the front plate assembly 154 and the pole piece 158. The magnet 152 may be a permanent magnet (e.g., comprising neodymium or a ferrous material, such as ferrite) or a temporary magnet (e.g., electromagnet). For example, a ring magnet design may include ferrite and/or a core magnet design may include neodymium. Other variations are possible.

The magnet 152 may be disposed between the front plate assembly 154 and the yoke assembly 160. The magnet 152 may be oriented to produce a magnetic field axially through first and second surfaces of the magnet, the first surface being opposite the second surface.

The yoke assembly 160 may be secured (e.g., adhered) to the magnet 152 on a surface of the magnet 152 opposite to the surface to which the front plate assembly 154 is secured. The yoke assembly 160 may be attached using an adhesive (e.g., glue), a bonding technique, or any other suitable technique. It may be advantageous to reduce a distance (e.g., gaps and/or an interface layer) between the front plate assembly 154 and the magnet 152, such as any caused by gluing or other attachment means. Various embodiments of the yoke assembly 160 (including the back plate 156 and/or pole piece 158) are described in more detail below.

As noted above, the loudspeaker 100 can include a second driver 140. A bridge 120 can be configured to dispose the second driver 140 proximal to the first driver 130. The bridge 120 can include a magnetic circuit configured such that, when activated, a diaphragm is displaced to emit sound. The first driver 130 may be configured to emit sound at a lower frequency than the second driver 140. Additionally or alternatively, the second driver 140 may be configured to emit sound at a higher frequency than the second driver 140. For example, the first driver 130 can be configured to emit frequencies below about 500 Hz. In some embodiments, the first driver 130 can be configured to emit frequencies at below about 400 Hz, about 300 Hz, about 250 Hz, about 200 Hz, about 150 Hz, about 125 Hz, about 100 Hz, any value therebetween, or within any range of values having endpoints therein. The diaphragm 110 can be configured to have a frequency response peak at between about 1.2 kHz and about 2.2 kHz, and in some embodiments the frequency response peak is about 1.7 kHz. In some embodiments, the second driver 140 can be configured to emit frequencies above about 1 kHz, 1.5 kHz, 2 kHz, 2.5 kHz, etc., and up to 10 kHz, 15 kHz, 20 kHz, 25 kHz, about 30 kHz, about 35 kHz, about 36 kHz, about 37 kHz, about 38 kHz, about 39 kHz, about 40 kHz, any value therebetween, or within any range of values having endpoints therein. Because the loudspeaker 100 can include both a first driver 130 and a second driver 140, the loudspeaker 100 can be configured to emit frequencies having any combination of frequencies emitted by the corresponding drivers 130, 140.

The loudspeaker 100 can include a variety of dimensions. For example, the loudspeaker 100 can have a diameter 116 of about 40 mm, about 50 mm, about 60 mm, about 70 mm, about 80 mm, about 90 mm, about 100 mm, about 110 mm, about 120 mm, about 130 mm, about 150 mm, about 200 mm, any value therebetween, or within any range of values having endpoints therein. In some embodiments, the diameter 116 of the loudspeaker 100 is about 80 mm. In some embodiments having a diaphragm 110 with elliptical or obround shape, the loudspeaker 100 can have a major axis of about 70 mm, about 80 mm, about 90 mm, about 100 mm, about 110 mm, about 120 mm, about 130 mm, about 150 mm, about 170 mm, about 200 mm, about 210 mm, about 220 mm, about 230 mm, and a minor axis of about 40 mm, about 50 mm, about 60 mm, about 70 mm, about 80 mm, about 90 mm, about 100 mm, about 110 mm, about 120 mm, about 130 mm, about 150 mm, about 170 mm, about 200 mm, respectively, any value therebetween, or within any range of values having endpoints therein.

The loudspeaker 100 can define a mounting depth 118 that extends from a base of the loudspeaker 100 and/or of the first driver 130 (e.g., a distal end of the yoke assembly 160) to a proximal portion of the frame 106 at about where the bridge 120 attaches to the frame 106. This proximal portion can be configured to engage with a mounting surface (e.g., of a car, a sound system, etc.). Thus, the mounting depth 118 can approximately represent a depth of space required within a surface to install the loudspeaker 100. The mounting depth 118 can be about 38 mm, about 40 mm, about 42 mm, about 44 mm, about 46 mm, about 48 mm, about 50 mm, about 55 mm, about 60 mm, about 70 mm, about 80 mm, any value therebetween, or within any range of values having endpoints therein. The mounting depth 118 may be greater or lower depending on the speaker arrangement. In some embodiments, the mounting depth 118 is about 40.5 mm. As described below, the loudspeaker 100 described herein can provide a uniquely low profile and thus a low mounting depth 118. This can allow for a more powerful loudspeaker 100 relative to its size (e.g., weight, physical dimensions).

The diaphragm 110 can be in an activated state (e.g., when an electrical signal is provided through the magnetic circuit assembly 150) and in a resting state (e.g., when no electrical signal is passing through the magnetic circuit assembly 150). An amplitude or displacement of the diaphragm 110 can be defined as an absolute value of a distance of the diaphragm 110 between its position in the resting state and the activated state. Under normal usage of the loudspeaker 100, the maximum displacement of the diaphragm 110 can be about 4 mm, about 4.5 mm, about 5 mm, about 5.5 mm, about 6 mm, about 6.5 mm, any value therebetween, or within any range of values having endpoints therein. In some embodiments, the displacement is about 6 mm. The displacement (or excursion) may be greater or lower depending on the speaker arrangement.

The loudspeaker 100 can define various ratios that indicate the novel dimensions that embodiments described herein can provide. For example, a ratio of the diameter 116 (in mm) of the loudspeaker 100 to the mounting depth (in mm) 118 can be greater than about 1.8, about 1.9, about 2, about 2.1, about 2.2, about 2.3, about 2.4, about 2.5, any value therebetween, or within any range of values having endpoints therein. In some embodiments, the ratio is about 1.97. The ratio may be larger or smaller depending on the speaker arrangement.

A ratio of the mounting depth (in mm) 118 to the maximum displacement (in mm) of the diaphragm 110 to may be smaller than about 6.5, about 6.75, about 7, about 7.2, about 7.4, about 7.6, about 7.8, about 8, any value therebetween, or within any range of values having endpoints therein. In some embodiments, the ratio is about 6.75.

A ratio of the diameter (mm) of the loudspeaker 100 to the displacement (in mm) of the diaphragm 110 may be greater than about 11, about 11.5, about 12, about 12.3, about 12.6, about 13, about 13.5, about 14, any value therebetween, or within any range of values having endpoints therein. In some embodiments, the ratio is about 13.3.

Figure 2:
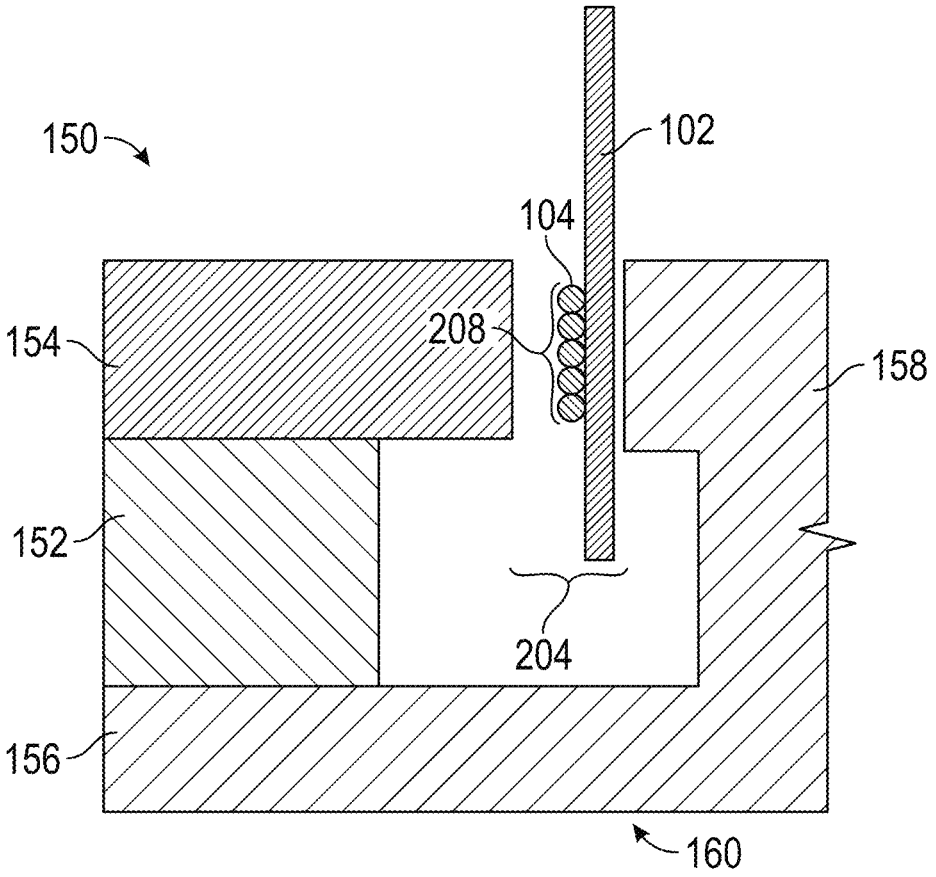
FIG. 2 shows a schematic of a cross-section of a magnetic circuit assembly that can be used in a loudspeaker.

FIG. 2 shows a schematic of a cross-section of a portion of a magnetic circuit assembly 150 that may, for example, be used in a loudspeaker. In some embodiments, a pole piece 158 may be used to complete a magnetic circuit within the magnetic circuit assembly 150. In some designs, the pole piece 158 includes one or more vents (e.g., hollow portion running axially through the pole piece 158), not shown in FIG. 2. Such vents may be beneficial in cooling the magnetic circuit assembly 150 and/or loudspeaker 100. The one or more vents could be disposed axially below the coil 104 (e.g., between the magnet 152 and the pole piece 158). Accordingly, one or more vents may be disposed radially from the axis A. The loudspeaker 100 can include a plurality of vents, such as 3, 4, 6, or 8. Where a plurality of vents is included, they may be positioned in radial symmetry. The one or more vents can be used to improve cooling, reduce the mechanical resistance, and/or reduce air noise. A vent disposed about the axis A may be more effective at reducing mechanical resistance while peripheral vents may be more effective at cooling the magnetic circuit (e.g., especially the coil 104). Such peripheral vents can promote cooling air over the coil.

The pole piece 158 may be shaped to accommodate different needs of various embodiments. In some embodiments, the pole piece 158 may be tapered at one end (e.g., front, back). This may allow for reduced manufacturing requirements, to allow for proper sizing and weight requirements for a loudspeaker, or to optimize an amount of magnetic flux through the pole piece 158, for example. As shown in FIG. 2, some embodiments include a flanged (e.g., L-shaped, T-shaped) pole piece 158 that may be useful in optimizing a target width (e.g., radial width) of a gap 204. Additionally or alternatively, the flanged pole piece 158 can allow for different designs for connection with other elements (e.g., frame 106) not shown in FIG. 2. However, in other embodiments, the pole piece 158 does not include a flange. In some designs, the pole piece 158 may include a surface opposite the magnet 152 that is generally smooth and/or flat. The surface may run parallel to the axis A, for example. In some embodiments, the surface represents a radial boundary of the pole piece 158. The pole piece 158 may consist of a single pole element (as shown in FIGS. 1-2), though in some embodiments the pole piece 158 comprises two or more elements. The front plate assembly 154 can be radially tapered (e.g., radially inward, radially outward) to accommodate certain structural designs of the loudspeaker 100.

The yoke assembly 160 provides a portion of the magnetic circuit of the magnetic circuit assembly 150. In some designs, the yoke assembly 160 includes two separate elements, such as a distinct back plate 156 and pole piece 158. However, the yoke assembly 160 may consist of a single piece where the back plate 156 and pole piece 158 form a continuous piece (as shown, for example, in FIGS. 1-2). The yoke assembly 160 may include at least one surface that is perpendicular to the axis A.

The magnetic circuit assembly 150 may be configured to generate a magnetic circuit through the front plate assembly 154, the yoke assembly 160, and across the gap 204. The magnetic circuit assembly 150 may be configured to pass between about 80 and 99 percent of the magnetic flux within the magnetic circuit across the gap 204. This may be particularly true for core magnet configurations. In some embodiments (e.g., a ring magnet design), the flux across the gap 204 may be between 50 and 80 percent of a total flux. In some embodiments, the flux may be about 70 percent of a total flux. Within the gap 204 may be one or more elements of the magnetic circuit assembly 150. For example, the bobbin 102 and/or coil 104 may be disposed within the gap 204. As the magnetic flux interacts with the coil 104, the coil 104 vibrates and may produce a sound, for example, from the loudspeaker 100.

As shown, in some embodiments (e.g., in ring magnet designs), the windings of the coil 104 are disposed on a side of the bobbin 102 opposite the pole piece 158. However, in other embodiments (e.g., core magnet designs), the windings of the coil 104 may be on a side of the bobbin 102 opposite the magnet 152. A height 208 of the coil 104 may be defined along the axis A (e.g., as shown in FIG. 5). In some embodiments, the height 208 of the coil 104 may be approximately equal to a height of the front plate assembly 154 and/or a flanged portion of the yoke assembly 160 (if applicable). In some designs, the height 208 of the coil 104 is smaller or greater than the height of the front plate assembly 154. The height 208 may be between about 0.1 mm and 150 mm. For larger speakers, larger heights 208 are possible. A width (e.g., radially) of the coil 104 may be between about 55 percent and 90 percent of the width of the gap 204. In some embodiments, the width of the coil 104 is about 71 percent or about 75 percent of the width of the gap 204. It may be advantageous to reduce the width of the gap 204. For example, reducing the width of the gap 204 may improve a performance of the loudspeaker 100, for example, by improving integrity of the sound relative to an electrical input. The gap 204 may be between about 1 mm and 12 mm wide. In some embodiments, the gap 204 has a width of about 3.5 mm. In some embodiments, the width is about 2 mm.

Magnetic circuit assemblies, such as those found in loudspeakers, may take various forms. For example, embodiments of magnetic circuit assemblies may include one or more features of those described generally above. It may be advantageous under certain circumstances to increase the amount of magnetic flux across a gap (e.g., the gap 204). This may be achieved in a number of ways. One way may include reducing or eliminating gaps (e.g., a glue gap or other interface layer) between separate components of the magnetic circuit, including, for example, gaps between magnet 152 components, front plate 154 components, back plate 156 components, pole piece 158 components, and/or between any of the foregoing components. For example, it may be advantageous to provide separate first and second plates in the front plate assembly 154 (not shown), each of which is directly secured to the magnet 152 (e.g., by glue). In some embodiments, the separate first and second front plates are forged and adhered to the magnet without machining, thus saving substantial manufacturing cost while eliminating gaps between front plate components and reducing magnetic losses.

Figure 3A:
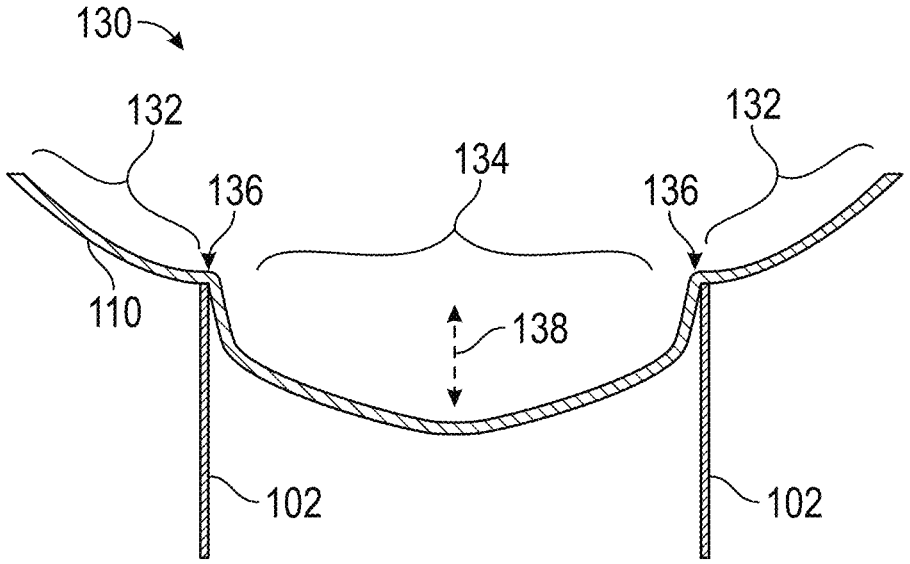
FIG. 3A schematically shows a driver having an upwardly concave peripheral region.
Figure 3B:
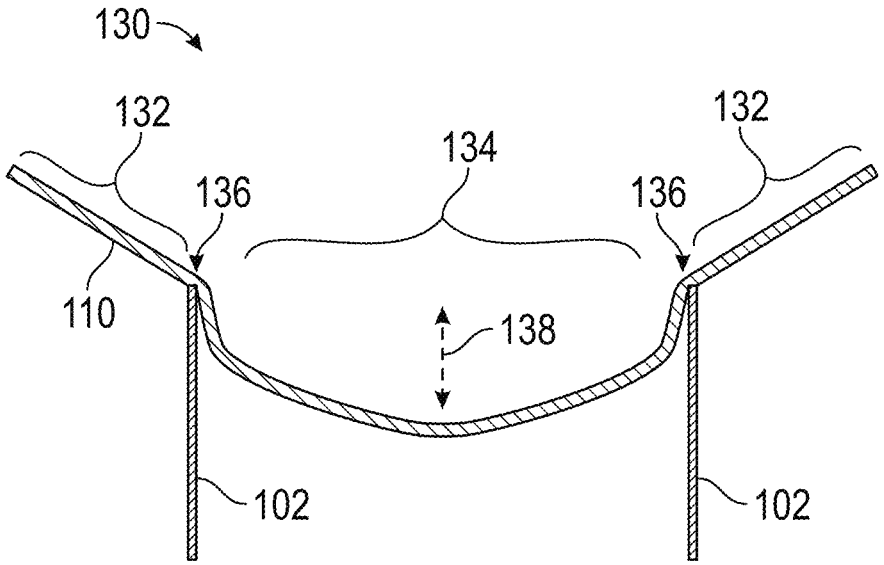
FIG. 3B schematically shows a driver having a conical peripheral region.
Figure 3C:
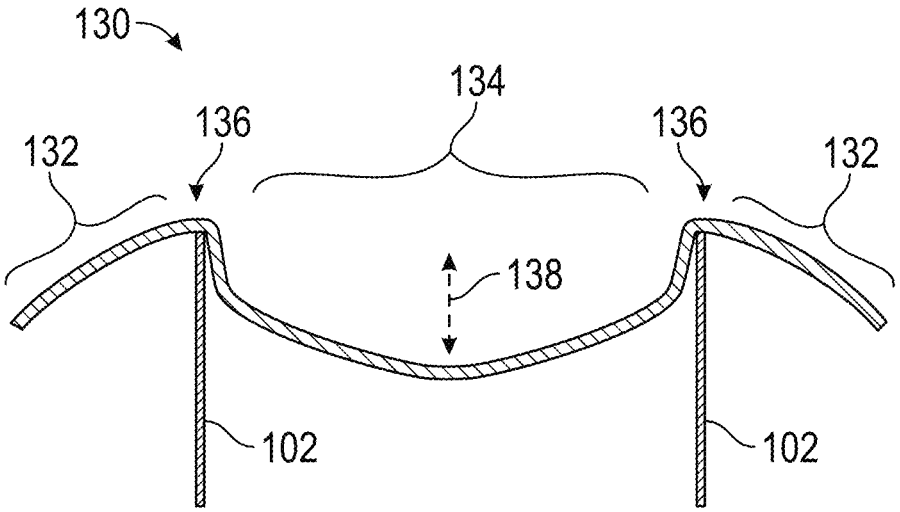
FIG. 3C schematically shows a driver having a downwardly concave peripheral region.

FIGS. 3A-3C illustrate various designs of the first driver 130 described herein. The diaphragm 110 can include a central region 134 and a peripheral region 132 radially outward of the central region 134. The diaphragm 110 can be attached to the bobbin 102 at a boundary 136. The boundary 136 can be disposed between the peripheral region 132 and the central region 134. The bobbin 102 may be attached (e.g., adhered) to a distal side of the diaphragm 110. The diaphragm 110 may consist of a unitary and/or single element. A cone displacement region 138 or diaphragm displacement region can describe the region in which the diaphragm 110 is displaced during the activated state. For example, the cone displacement region 138 may comprise the volume a maximum displacement above and below the diaphragm 110 in the resting state. The cone displacement region 138 can have a depth of, for example, about 12 cm if the maximum displacement is 6 cm. The cone displacement region can be configured to permit displacement of the cone of the first driver such that the cone displacement region is disposed between (e.g., axially between) the second driver 140 and the pole plate 158 and/or front plate assembly 154 of the first driver. Because the diaphragm 110 is a unitary element in certain embodiments, the diaphragm 110 can be larger than in prior art designs. The diaphragm 110 may have, for example, 20% (or more) surface area due to the unitary diaphragm design. This can correlate with an increase in 1.7 dB of volume. Moreover, this design can save up to about 6-8 mm of mounting depth compared to prior art designs with similar speaker diameters. The diaphragm 110 can comprise mica paper, polypropylene, aluminum, or other suitable material.

As described herein, the loudspeaker 100 can provide a uniquely low profile and/or small mounting depth 118. This can be achieved, for example, by reducing a depth of the cone displacement region 138 and/or moving the second driver 140 axially closer to the first driver 130. For example, the second driver 140 can be configured to be disposed at least partially within the bobbin 102. For example, the second driver 140 (e.g., a base or yoke of the second driver 140) may intersect the boundary plane formed by the attachment of the bobbin 102 to the diaphragm 110 at the boundary 136. Because the space within the bobbin 102 can be at least partially occupied by the second driver 140, the mounting depth 118 and/or profile of the loudspeaker 100 can be reduced. In some embodiments, the diaphragm 110 can be disposed relative to the second driver 140 such that the cone displacement region 138 is disposed completely distally from the boundary.

The central region 134 can be recessed distally from the boundary 136 to accommodate the second driver 140. Additionally or alternatively, the peripheral region 132 can be shaped to provide high quality sound and volume. For example, as shown in FIG. 3A, the peripheral region 132 can have an upwardly or proximally concave shape. As shown, a radius curvature of the peripheral region 132 near the boundary 136 can be greater than a radius of curvature of the central region 134 near the boundary 136. The central region 134 of the diaphragm 110 can exhibit an abrupt downward orientation radially inward from (but near) the boundary 136. Thus, a transition from the peripheral region 132 to the central region 134 may not be smooth.

Figure 3D:
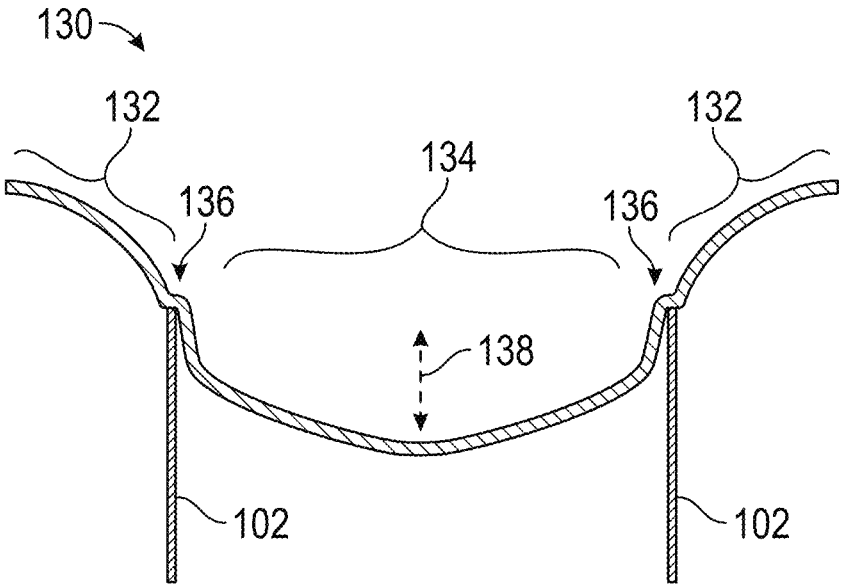
FIG. 3D schematically shows a driver having an upwardly convex peripheral region.

As shown in FIG. 3B, the peripheral region 132 can have a substantially conical shape. The conical shape may be oriented proximally (as shown) or distally. FIG. 3C shows the peripheral region 132 having a downwardly or distally concave shape. FIG. 3D shows the peripheral region 132 having an upwardly convex peripheral region. Other shapes are possible.

Example Embodiments

Some non-limiting examples embodiments are provided below:

In a 1st example, a coaxial loudspeaker comprises: a first driver comprising: a magnetic circuit having a front plate assembly; a voice coil positioned within the magnetic circuit; a bobbin connected to the voice coil; and a cone attached to the bobbin; wherein the cone comprises a center region, a peripheral region surrounding the center region, and a boundary connecting the center region and the peripheral region; a bridge configured to position a second driver coaxial with and proximal to the first driver; and a cone displacement region configured to permit displacement of the cone of the first driver, wherein the cone displacement region is disposed between the second driver and the front plate assembly of the first driver; wherein the center region of the cone is recessed distally from the boundary.

In a 2nd example, the loudspeaker of example 1, wherein the cone consists of a unitary element.

In a 3rd example, the loudspeaker of any of examples 1-2, wherein the bobbin is attached to the cone at the boundary.

In a 4th example, the loudspeaker of example 3, wherein the bobbin is attached at a distal side of the cone.

In a 5th example, the loudspeaker of example 4, wherein the boundary defines a boundary plane substantially perpendicular to an axis coaxial with the first and second drivers, and wherein at least a portion of the second driver intersects the boundary plane.

In a 6th example, the loudspeaker of any of examples 1-5, wherein the peripheral portion of the cone comprises a concave shape.

In a 7th example, the loudspeaker of any of examples 1-6, wherein the peripheral portion of the cone comprises a conical shape or a convex shape.

In a $8^{th}$ example, the loudspeaker of any of examples 1-7, wherein a ratio of the diameter (in mm) of the loudspeaker to a mounting depth (in mm) defined from a base of the loudspeaker to a surface configured to couple with a mounting surface is greater than about 2.

In a 9th example, the loudspeaker of any of examples 1-8, wherein a ratio of a mounting depth (in mm) defined from a base of the loudspeaker to a surface configured to couple with a mounting surface to a displacement (in mm) from a resting position of the cone is less than about 7.

In a 10th example, the loudspeaker of any of examples 1-9, wherein a ratio of the diameter (in mm) of the loudspeaker to a displacement (in mm) of the cone from a resting position is greater than about 13.

In a 11th example, the loudspeaker of any of examples 1-10, wherein the loudspeaker is configured to produce audio frequencies below 200 Hz and greater than 15 kHz.

In a 12th example, a coaxial loudspeaker comprises: a first driver disposed distal to a second driver, the second driver configured to produce higher audio frequencies than the first driver, the first driver comprising a base and a diaphragm proximal to the base, the diaphragm configured to have a maximum displacement between an activated state and a resting state; and a bridge configured to position the second driver coaxial with the first driver, the bridge extending radially outward of the diaphragm at an attachment point and defining a mounting depth from a base of the attachment point and the base of the first driver; wherein a ratio of the mounting depth (mm) to the maximum displacement (in mm) is less than about 7.

In a 13th example, the loudspeaker of example 12, wherein the first driver comprises: a magnetic circuit having a pole plate; a voice coil positioned within the magnetic circuit; and a bobbin connected to the voice coil, wherein the diaphragm is connected to the bobbin at a distal side of the diaphragm.

In a 14th example, the loudspeaker of example 13, wherein the diaphragm comprises a center region, a peripheral region surrounding the center region, and a boundary connecting the center region and the peripheral region, wherein the center region of the diaphragm is recessed distally from the boundary.

In a 15th example, the loudspeaker of example 14, wherein the bobbin is attached to the diaphragm at the boundary.

In a 16th example, the loudspeaker of example 15, wherein the diaphragm consists of a unitary element.

In a 17th example, the loudspeaker of any of examples 14-16, wherein the boundary defines a boundary plane substantially perpendicular to an axis coaxial with the first and second drivers, and wherein at least a portion of the second driver intersects the boundary plane.

In a 18th example, the loudspeaker of any of examples 14-17, wherein the peripheral portion of the diaphragm comprises a concave shape.

In a 19th example, the loudspeaker of any of examples 14-18, wherein the peripheral portion of the diaphragm comprises a conical shape.

In a 20th example, the loudspeaker of any of examples 12-19, wherein a ratio of the diameter (in mm) of the loudspeaker to a mounting depth (in mm) defined from a base of the loudspeaker to a surface configured to couple with a mounting surface is greater than about 1.9.

CONCLUSION

Reference throughout this specification to "some embodiments" or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment. Accordingly, no feature or group of features is necessary or indispensable to each embodiment.

A number of applications, publications, and external documents may be incorporated by reference herein. Any conflict or contradiction between a statement in the body text of this specification and a statement in any of the incorporated documents is to be resolved in favor of the statement in the body text.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

What is claimed is:

1. A coaxial loudspeaker comprising:

a first driver comprising:

a magnetic circuit having a front plate assembly;

a voice coil positioned within the magnetic circuit;

a bobbin connected to the voice coil; and a cone attached to the bobbin;

wherein the cone comprises a center region, a peripheral region surrounding the center region, and a boundary connecting the center region and the peripheral region;

a bridge configured to position a second driver coaxial with and proximal to the first driver; and a cone displacement region configured to permit displacement of the cone of the first driver, wherein the cone displacement region is disposed between the second driver and the front plate assembly of the first driver;

wherein the center region of the cone is recessed distally from the boundary.

2. The loudspeaker of claim 1, wherein the cone consists of a unitary element.

3. The loudspeaker of claim 1, wherein the bobbin is attached to the cone at the boundary.

4. The loudspeaker of claim 3, wherein the bobbin is attached at a distal side of the cone.

5. The loudspeaker of claim 4, wherein the boundary defines a boundary plane substantially perpendicular to an axis coaxial with the first and second drivers, and wherein at least a portion of the second driver intersects the boundary plane.

6. The loudspeaker of claim 1, wherein the peripheral portion of the cone comprises a concave shape.

7. The loudspeaker of claim 1, wherein the peripheral portion of the cone comprises a conical shape or a convex shape.

8. The loudspeaker of claim 1, wherein a ratio of the diameter (in mm) of the loudspeaker to a mounting depth (in mm) defined from a base of the loudspeaker to a surface configured to couple with a mounting surface is greater than about 2.

9. The loudspeaker of claim 1, wherein a ratio of a mounting depth (in mm) defined from a base of the loudspeaker to a surface configured to couple with a mounting surface to a displacement (in mm) from a resting position of the cone is less than about 7.

10. The loudspeaker of claim 1, wherein a ratio of the diameter (in mm) of the loudspeaker to a displacement (in mm) of the cone from a resting position is greater than about 13.

11. The loudspeaker of claim 1, wherein the loudspeaker is configured to produce audio frequencies below 200 Hz and greater than 15 kHz.

12. A coaxial loudspeaker comprising:

a first driver disposed distal to a second driver, the second driver configured to produce higher audio frequencies than the first driver, the first driver comprising a base and a diaphragm proximal to the base, the diaphragm configured to have a maximum displacement between an activated state and a resting state; and a bridge configured to position the second driver coaxial with the first driver, the bridge extending radially outward of the diaphragm at an attachment point and defining a mounting depth from a base of the attachment point and the base of the first driver;

wherein a ratio of the mounting depth (mm) to the maximum displacement (in mm) is less than about 7.

13. The loudspeaker of claim 12, wherein the first driver comprises:

a magnetic circuit having a pole plate;

a voice coil positioned within the magnetic circuit; and a bobbin connected to the voice coil, wherein the diaphragm is connected to the bobbin at a distal side of the diaphragm.

14. The loudspeaker of claim 13, wherein the diaphragm comprises a center region, a peripheral region surrounding the center region, and a boundary connecting the center region and the peripheral region, wherein the center region of the diaphragm is recessed distally from the boundary.

15. The loudspeaker of claim 14, wherein the bobbin is attached to the diaphragm at the boundary.

16. The loudspeaker of claim 15, wherein the diaphragm consists of a unitary element.

17. The loudspeaker of claim 14, wherein the boundary defines a boundary plane substantially perpendicular to an axis coaxial with the first and second drivers, and wherein at least a portion of the second driver intersects the boundary plane.

18. The loudspeaker of claim 14, wherein the peripheral portion of the diaphragm comprises a concave shape.

19. The loudspeaker of claim 14, wherein the peripheral portion of the diaphragm comprises a conical shape or a convex shape.

20. The loudspeaker of claim 12, wherein a ratio of the diameter (in mm) of the loudspeaker to a mounting depth (in mm) defined from a base of the loudspeaker to a surface configured to couple with a mounting surface is greater than about 1.9.

* * * * *